US006404395B1

(12) United States Patent
Masuda

(10) Patent No.: US 6,404,395 B1
(45) Date of Patent: Jun. 11, 2002

(54) PATTERN ANTENNA AND WIRELESS COMMUNICATION DEVICE EQUIPPED THEREWITH

(75) Inventor: Yoshiyuki Masuda, Tokyo (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/927,634

(22) Filed: Aug. 13, 2001

(30) Foreign Application Priority Data

Aug. 31, 2000 (JP) ..... 2000-262724

(51) Int. Cl.[7] ..... H01Q 1/24
(52) U.S. Cl. ..... 343/702; 343/700 MS
(58) Field of Search ..... 343/702, 700 MS, 343/846, 853

(56) References Cited

U.S. PATENT DOCUMENTS 5,365,246 A * 11/1994 Rasinger et al. ..... 343/702
5,764,190 A * 6/1998 Murch et al. ..... 343/702
5,966,097 A * 10/1999 Fukasawa et al. ... 343/700 MS
6,147,652 A * 11/2000 Sekine ..... 343/702
6,295,030 B1 * 9/2001 Kozakai et al. ..... 343/700 MS
6,326,924 B1 * 12/2001 Muramoto et al. ..... 343/702

FOREIGN PATENT DOCUMENTS

| | | | |
|---|---|---|---|
| JP | 5-347511 | 12/1993 | ..... H01Q/13/08 |
| JP | 6-334421 | 12/1994 | ..... H01Q/1/38 |
| JP | A2000-591320 | 2/2000 | ..... H01Q/13/08 |

* cited by examiner

*Primary Examiner*—Don Wong
*Assistant Examiner*—Hoang Nguyen

(57) ABSTRACT

An inverted-F-shaped antenna pattern 1 is formed as a driven element on a surface of a glass-epoxy circuit board 4. This antenna pattern 1 has a feeding conductor pattern 1*b* connected to a feeding transmission path 2 formed on the surface of the circuit board 4 and a grounding conductor pattern 1*c* connected to a grounding conductor portion 3 formed on the surface of the circuit board 4. The feeding conductor pattern 1*b* is formed so as to have a tapered shape so that its width increases gradually from where it is connected to the feeding transmission path 2 toward an elongate pattern 1*a* of the antenna pattern 1.

36 Claims, 11 Drawing Sheets

PATTERN ANTENNA AND WIRELESS COMMUNICATION DEVICE EQUIPPED THEREWITH

BACKGROUND OF THE INVENTION

1. Field of the Invention

The present invention relates to a pattern antenna formed on a circuit board. The present invention relates particularly to a pattern antenna that is compact and lightweight but that nevertheless permits wide-range transmission and reception, and to a wireless communication device equipped with such a pattern antenna.

2. Description of the Prior Art

In mobile communication using compact wireless devices such as cellular phones or indoor wireless LAN (local area network) terminals, those wireless devices, used as mobile units, need to be equipped with compact, high-performance antennas. As compact antennas for such applications, slim planar antennas have been receiving much attention because they can be incorporated in devices. As planar antennas are used microstrip antennas, of which typical examples are short-circuiting microstrip antennas as shown in FIG. 20A and planar inverted-F-shaped antennas as shown in FIG. 20B. In recent years, as wireless devices are made increasingly compact, planar antennas obtained by farther miniaturizing microstrip antennas as shown in FIG. 20A have been proposed, for example, in Japanese Patent Applications Laid-Open Nos. H5-347511 and 2000-59132.

The antennas proposed in Japanese Patent Applications Laid-Open Nos. H5-347511 and 2000-59132 are miniaturized as compared with common planar or linear antennas that have conventionally been used. However, either of these antennas is formed three-dimensionally on a circuit board, and thus requires a space dedicated thereto on the circuit board to which it is grounded. This sets a limit to the miniaturization of these types of antenna.

FIG. 22 shows the frequency response of the voltage standing wave ratio (VSWR) of an inverted-F-shaped printed pattern antenna 100 as shown in FIG. 21. In FIG. 21, the inverted-F-shaped printed pattern antenna 100 consists of an elongate pattern 100*a* that is formed parallel to a side edge of the grounding conductor portion 101 that faces it, a grounding conductor pattern 100*c* that is connected at one end to the end of the elongate pattern 100*a* opposite to the open end 100*d* thereof and that is connected at the other end to the grounding conductor pattern 101, and a feeding conductor pattern 100*b* that is connected at one end to a point on the elongate pattern 100*a* between the open end 100*d* of the elongate pattern 100*a* and the grounding conductor pattern 100*c* and that is connected at the other end to a feeding transmission path 102. As FIG. 22 shows, the inverted-F-shaped printed pattern antenna 100 configured in this way is usable only in a narrow frequency range.

On the other hand, Japanese Patent Application Laid-Open No. H6-334421 proposes a wireless communication product that employs a circuit-board-mounted antenna such as an inverted-L-shaped printed pattern antenna. However, on its own, an inverted-L-shaped printed pattern antenna is usable only in a narrow frequency range as described above. According to another proposal, an inverted-L-shaped printed pattern antenna is used together with a microstrip-type planar antenna to make it usable in a wider frequency range. However, this requires an unduly large area to be secured for the antennas, and thus hinders their miniaturization.

SUMMARY OF THE INVENTION

An object of the present invention is to provide a pattern antenna that is miniaturized by the use of a pattern antenna that is formed as a pattern on the surface or inside a circuit board, and to provide a wireless communication device equipped with such a pattern antenna.

To achieve the above object, according to one aspect of the present invention, a pattern antenna formed on a circuit board is provided with an inverted-F-shaped antenna pattern that is formed on a surface of the circuit board, has one end serving as a feeding portion and the other end left as an open end, has a bent portion formed between the feeding portion and the open end, with the portion of the inverted-F-shaped antenna pattern between the feeding portion and the bent portion serving as a feeding conductor pattern, and has a grounding conductor pattern formed so as to extend from a point between the feeding portion and the open end. Here, at least one of the feeding conductor pattern and the grounding conductor pattern is formed so as to have a trapezoid shape.

According to another aspect of the present invention, a pattern antenna formed on a circuit board is provided with an inverted-L-shaped antenna pattern that is formed on a surface of the circuit board, has one end serving as a feeding portion and the other end left as an open end, and has a bent portion formed between the feeding portion and the open end, with the portion of the inverted-L-shaped antenna pattern between the feeding portion and the bent portion serving as a feeding conductor pattern. Here, the feeding conductor pattern is formed so as to have a trapezoid shape.

According to another aspect of the present invention, in a wireless communication device having a pattern antenna that permits at least either transmission or reception of a communication signal to or from an external device, the pattern antenna is provided with an inverted-F-shaped antenna pattern that is formed on a surface of the circuit board, has one end serving as a feeding portion and the other end left as an open end, has a bent portion formed between the feeding portion and the open end, with the portion of the inverted-F-shaped antenna pattern between the feeding portion and the bent portion serving as a feeding conductor pattern, and has a grounding conductor pattern formed so as to extend from a point between the feeding portion and the open end. Here, at least one of the feeding conductor pattern and the grounding conductor pattern is formed so as to have a trapezoid shape.

According to another aspect of the present invention, in a wireless communication device having a pattern antenna that permits at least either transmission or reception of a communication signal to or from an external device, the pattern antenna is provided with an inverted-L-shaped antenna pattern that is formed on a surface of the circuit board, has one end serving as a feeding portion and the other end left as an open end, and has a bent portion formed between the feeding portion and the open end, with the portion of the inverted-L-shaped antenna pattern between the feeding portion and the bent portion serving as a feeding conductor pattern. Here, the feeding conductor pattern is formed so as to have a trapezoid shape.

BRIEF DESCRIPTION OF THE DRAWINGS

This and other objects and features of the present invention will become clear from the following description, taken in conjunction with the preferred embodiments with reference to the accompanying drawings in which.

DESCRIPTION OF THE PREFERRED EMBODIMENTS

Hereinafter, embodiments of the present invention will be described.

First Embodiment

Figure 1:
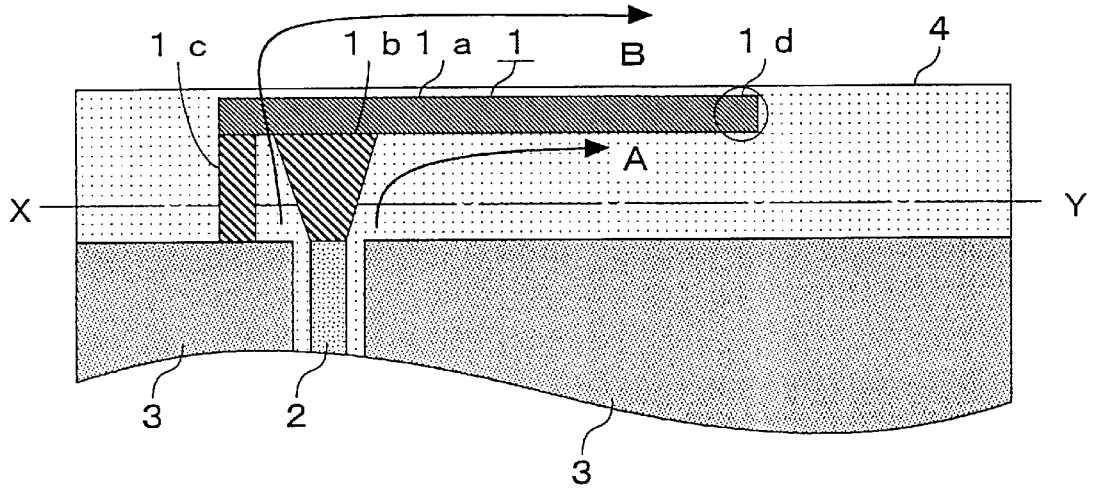
FIG. 1 is a plan view showing the configuration of the inverted-F-shaped antenna pattern in the pattern antenna of a first embodiment of the invention.
Figure 2:
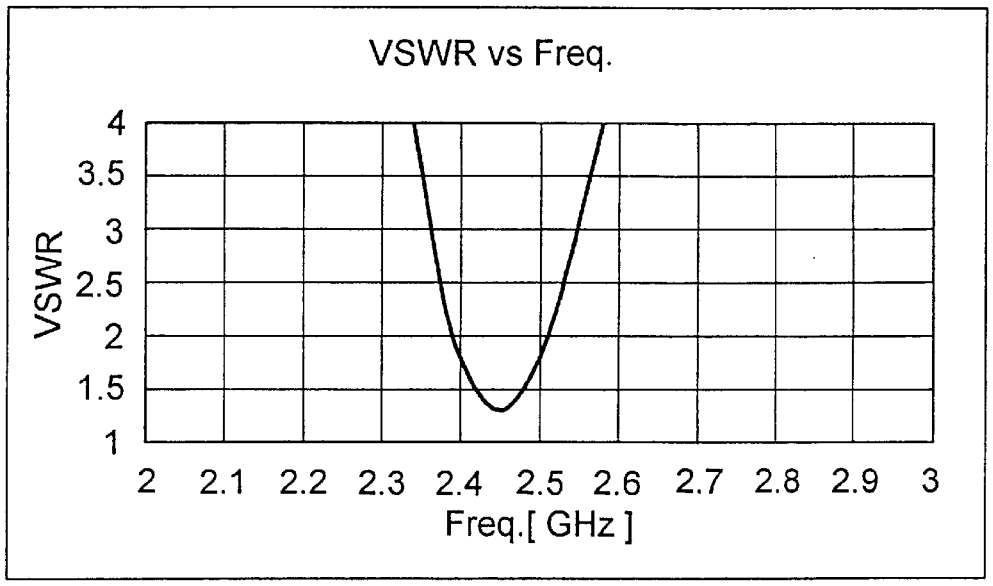
FIG. 2 is a diagram showing the frequency response of the voltage standing wave ratio of the pattern antenna of the first embodiment.

A first embodiment of the invention will be described below with reference to the drawings. FIG. 1 is a diagram showing the surface of the pattern antenna of this embodiment. FIG. 2 is a graph showing the frequency response of the voltage standing wave ratio (VSWR) of the pattern antenna of this embodiment.

The pattern antenna of this embodiment is composed of an inverted-F-shaped antenna pattern 1 formed on the surface of a glass-epoxy (i.e. glass-fiber-reinforced epoxy resin) circuit board 4 as shown in FIG. 1. The inverted-F-shaped antenna pattern 1 is formed in an edge portion of the circuit board 4, which has other circuit patterns and the like also formed thereon.

As shown in FIG. 1, on the surface of the circuit board 4, two grounding conductor portions 3 are formed, and, between these two grounding conductor portions 3, a feeding transmission path 2 is formed. As shown in FIG. 1, the inverted-F-shaped antenna pattern 1 formed on the surface of the circuit board 4 consists of an elongate pattern 1*a* that is formed parallel to a side edge of the grounding conductor portion 3 that faces it, a grounding conductor pattern 1*c* that is connected at one end to the end of the elongate pattern 1*a* opposite to the open end 1*d* thereof and that is connected at the other end to the grounding conductor portion 3, and a feeding conductor pattern 1*b* that is connected at one end to a point on the elongate pattern 1*a* between the open end 1*d* of the elongate pattern 1*a* and the grounding conductor pattern 1*c* and that is connected at the other end to the feeding transmission path 2.

Here, the feeding conductor pattern 1*b* is formed so as to have a tapered shape so that its width increases from where it is connected to the feeding transmission path 2 toward the elongate pattern 1*a*. In the inverted-F-shaped antenna pattern 1, assuming that the effective wavelength of the antenna at the center frequency of the usable frequency range thereof is $\lambda$, the preferred path length Li of the elongate pattern 1*a* from the open end 1*d* through the grounding conductor pattern 1*c* to the grounding conductor portion 3 is about $0.25\times\lambda$.

Moreover, the preferred gap between the elongate pattern 1*a* and the grounding conductor portion 3 is $0.02\times\lambda$ or wider. The reason is that, just as the usable frequency range of an inverted-F-shaped or similar antenna becomes narrower as the gap between its radiator plate and grounding conductor portion becomes narrower, the usable frequency range of the inverted-F-shaped antenna pattern 1 under discussion becomes narrower as the gap between it and the grounding conductor portion 3 becomes narrower. Furthermore, considering the accuracy with which the patterns are formed, the preferred pattern line width of the inverted-F-shaped antenna pattern 1 constituting the pattern antenna is 0.5 mm or wider.

In the pattern antenna configured as described above, the inverted-F-shaped antenna pattern 1, which functions as a driven element, has its feeding conductor pattern 1*b* formed so as to have a tapered shape. As a result, the elongate pattern 1*a* has different path lengths, from the open end 1*d* through the feeding conductor pattern 1*b* to the feeding transmission path 2, along its inner side, indicated by arrow A, and along its outer side, indicated by arrow B.

Thus, for example, when the inner path length, indicated by arrow A, is made shorter than $0.25\times\lambda$ and the outer path length, indicated by arrow B, is made longer than $0.25\times\lambda$, the usable frequency range resulting from the inner path length and that resulting from the outer path length affect each other, so that the voltage standing wave ratio of the pattern antenna configured as shown in FIG. 1 exhibits a frequency response as shown in FIG. 2, offering a wider range in which VSWR <2 than is obtained conventionally. This makes it possible to achieve satisfactory impedance matching in a wide frequency range and thereby transmit and receive communication signals in a wide frequency range.

Figure 3A:
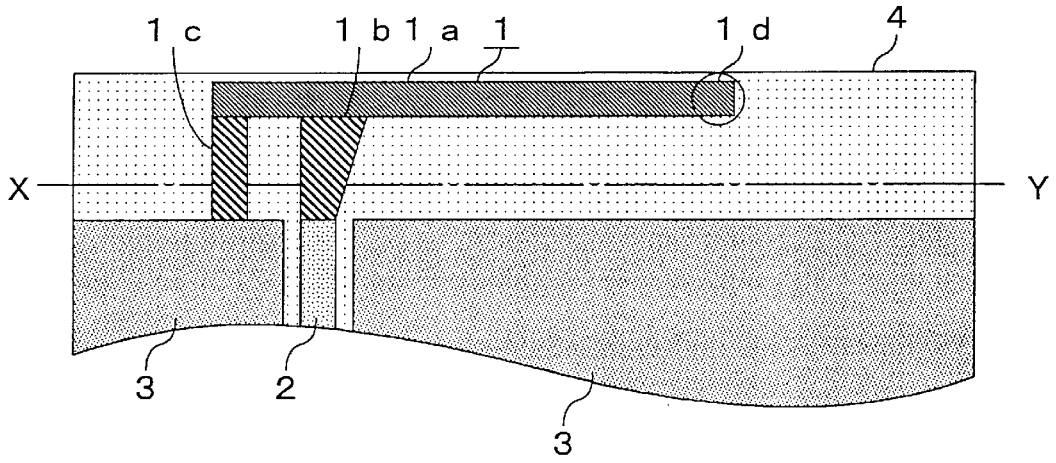
FIGS. 3A to 3C are plan views showing other configurations than the one shown in FIG. 1 of the antenna pattern in the pattern antenna of the first embodiment.
Figure 3B:
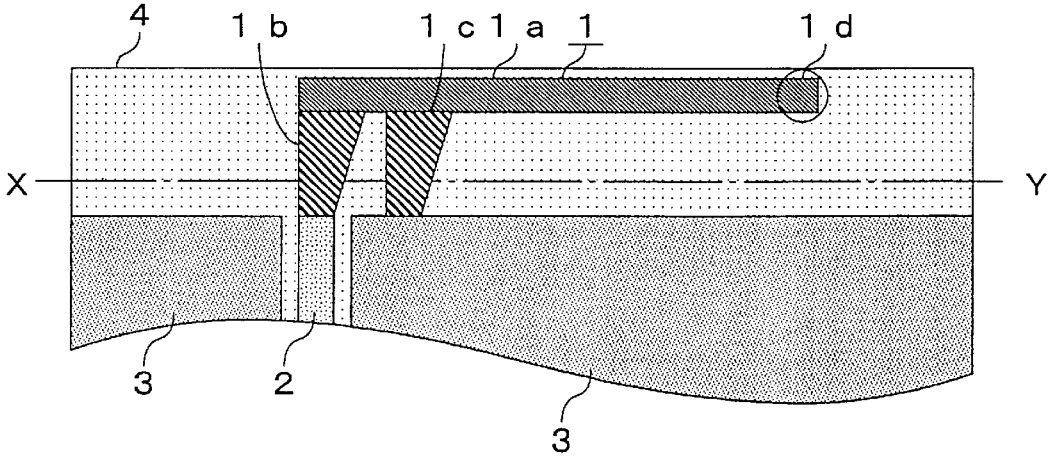

In this embodiment, the pattern antenna has been described as being composed of an inverted-F-shaped antenna pattern 1 as shown in FIG. 1. However, its feeding conductor pattern 1*b* does not necessarily have to be formed to have a radially widening shape with equal taper angles on both sides, but may be formed to have a radially widening shape with a taper angle only on one side as shown in FIG. 3A. Moreover, in addition to the feeding conductor pattern 1*b*, the grounding conductor pattern 1*c* may also be formed to have a tapered shape as shown in FIG. 3B.

Figure 3C:
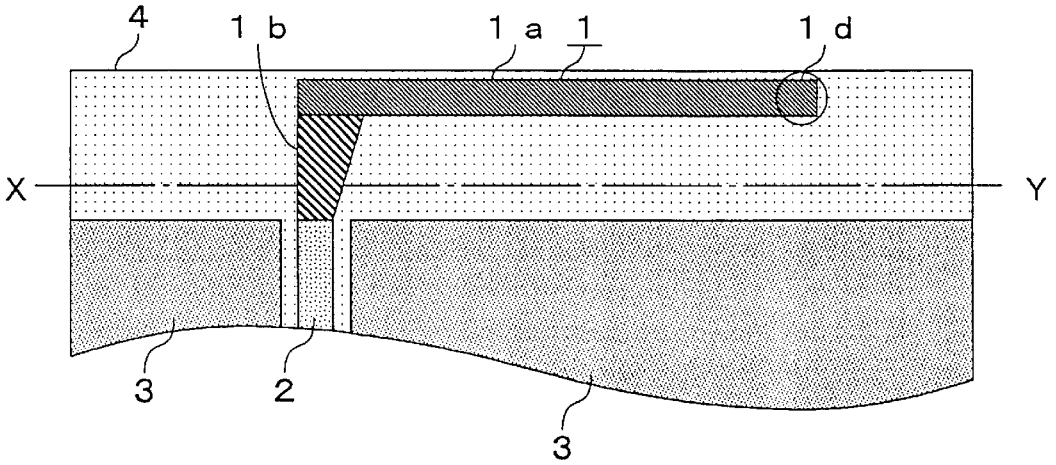

Furthermore, in a case where the gap between the elongate pattern 1*a* and the grounding conductor portion 3 is sufficiently wide, and thus sufficient impedance matching with a feeding line, to which the elongate pattern 1*a* is connected through the feeding transmission path 2, is achieved without providing the grounding conductor pattern 1*c* connected to the end of the elongate pattern 1*a* opposite to the open end 1*d* thereof, the pattern antenna may be, as shown in FIG. 3C, composed of an inverted-L-shaped antenna pattern consisting of an elongate pattern 1*a* and a taper-shaped feeding conductor pattern 1*b* connected to one end of the elongate pattern 1*a* opposite to the open end 1*d* thereof. When an inverted-L-shaped antenna pattern as shown in FIG. 3C is used, the preferred path length of the elongate pattern 1*a* from the open end 1*d* through the feeding conductor pattern 1*b* to the feeding transmission path 2 is about $0.25\times\lambda$.

Second Embodiment

Figure 4:
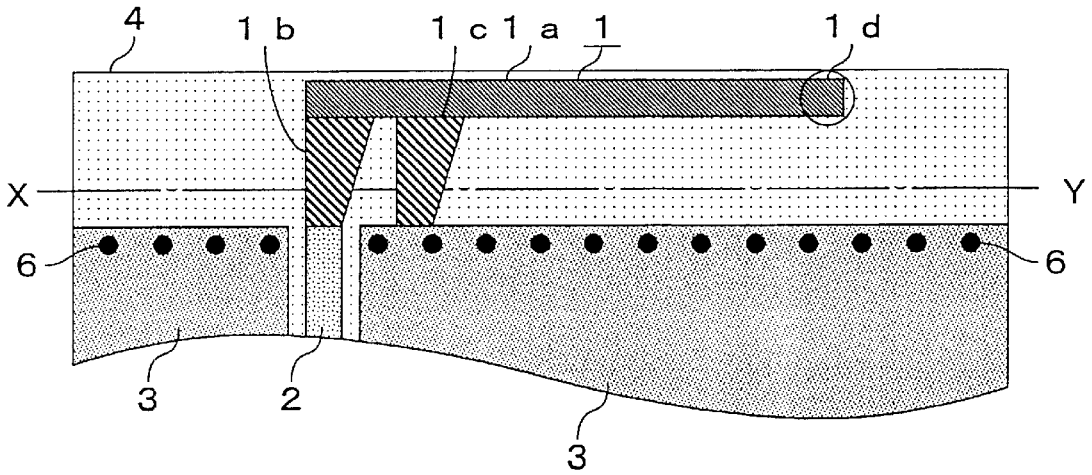
FIG. 4 is a plan view showing the configuration of the inverted-F-shaped antenna pattern in the pattern antenna of a second embodiment of the invention.
Figure 5:
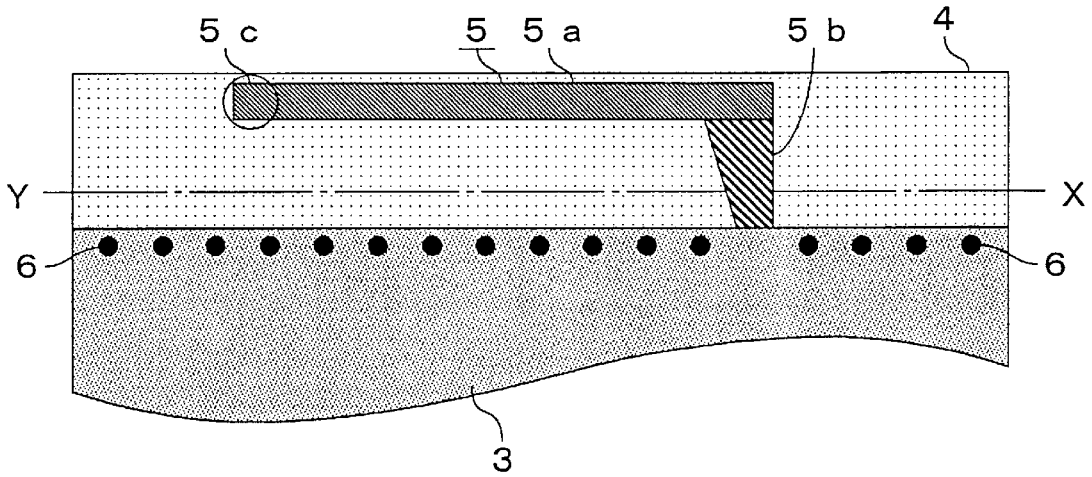
FIG. 5 is a plan view showing the configuration of the inverted-L-shaped antenna pattern in the pattern antenna of the second embodiment.
Figure 6:
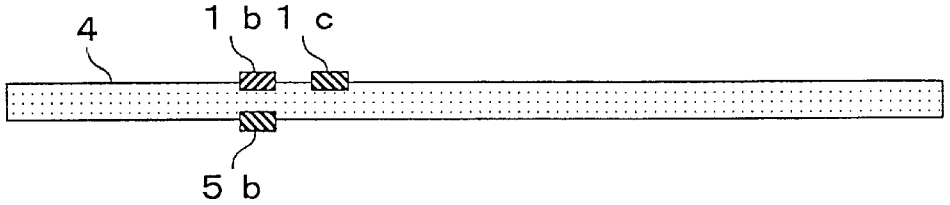
FIG. 6 is a sectional view showing the configuration of the pattern antenna of the second embodiment.
Figure 7:
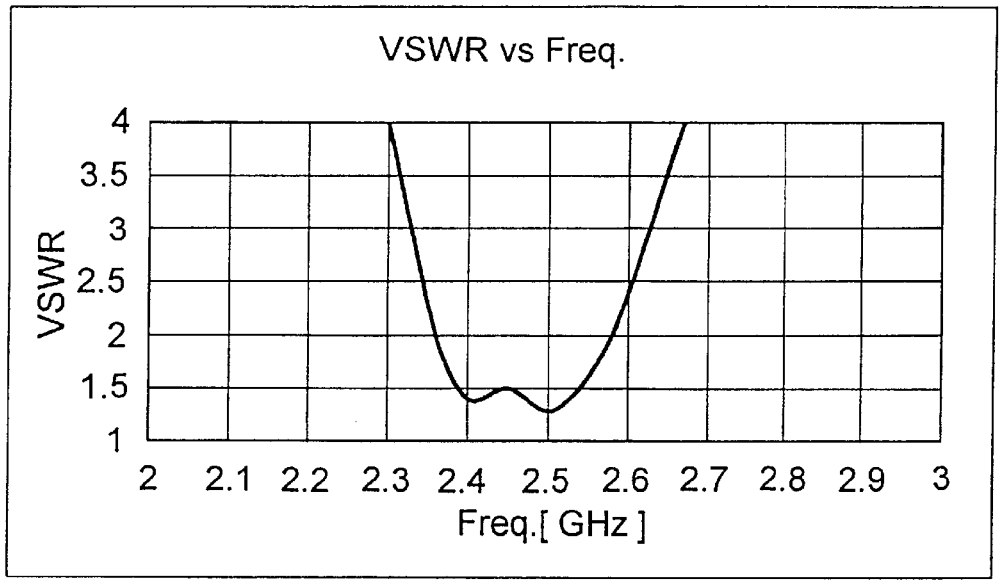
FIG. 7 is a diagram showing the frequency response of the voltage standing wave ratio of the pattern antenna of the second embodiment.

A second embodiment of the invention will be described below with reference to the drawings. FIG. 4 is a diagram showing the obverse-side surface of the pattern antenna of this embodiment. FIG. 5 is a diagram showing the reverse-side surface of the pattern antenna of this embodiment. FIG. 6 is a sectional view of the pattern antenna of this embodiment, taken along line X-Y shown in FIGS. 1 and 2. FIG. 7 is a graph showing the frequency response of the voltage standing wave ratio (VSWR) of the pattern antenna of this embodiment. Here, such elements as are used for the same purposes as in the pattern antenna of the first embodiment are identified with the same reference numerals, and their detailed explanations will not be repeated.

The pattern antenna of this embodiment is composed of an inverted-F-shaped antenna pattern 1 formed on the obverse-side surface of a glass-epoxy (i.e. glass-fiber-reinforced epoxy resin) circuit board 4 as shown in FIG. 4 and an inverted-L-shaped antenna pattern 5 formed on the reverse-side surface of the circuit board 4 as shown in FIG. 5. The inverted-F-shaped antenna pattern 1 and the inverted-L-shaped antenna pattern 5 are formed in an edge portion of the circuit board 4, which has other circuit patterns and the like also formed thereon.

As shown in FIG. 4, on the obverse-side surface of the circuit board 4, two grounding conductor portions 3 are formed, and, between these two grounding conductor portions 3, a feeding transmission path 2 is formed. In peripheral portions of the grounding conductor portions 3, through holes 6 are formed that permit the grounding conductor portions 3 to be electrically connected to other circuit patterns. As shown in FIG. 5, on the reverse-side surface of the circuit board 4, as on the obverse-side surface thereof, a grounding conductor portion 3 is formed with through holes 6 formed in a peripheral portion thereof. The two grounding conductor portions 3 on the obverse-side surface of the circuit board 4 are formed so as to overlap the grounding conductor portion 3 on the reverse-side surface of the circuit board 4 with the material of the circuit board 4 sandwiched in between.

As shown in FIG. 4, the inverted-F-shaped antenna pattern 1 formed on the obverse-side surface of the circuit board 4 consists of an elongate pattern 1*a* that is formed parallel to a side edge of the grounding conductor portion 3 that faces it, a feeding conductor pattern 1*b* that is connected at one end to the end of the elongate pattern 1*a* opposite to the open end 1*d* thereof and that is connected at the other end to the feeding transmission path 2, and a grounding conductor pattern 1*c* that is connected at one end to a point on the elongate pattern 1*a* between the open end 1*d* of the elongate pattern 1*a* and the feeding conductor pattern 1*b* and that is connected at the other end to the grounding conductor portion 3. In the inverted-F-shaped antenna pattern 1 configured in this way, both the feeding conductor pattern 1*b* and the grounding conductor pattern 1*c* are formed so as to have a radially widening shape with a taper angle only on one side as shown in FIG. 3B.

On the other hand, as shown in FIG. 5, the inverted-L-shaped antenna pattern 5 formed on the reverse-side surface of the circuit board 4 consists of an elongate pattern 5*a* that is formed parallel to a side edge of the grounding conductor portion 3 that faces it, and a grounding conductor pattern 5*b* that is connected at one end to the end of the elongate pattern 5*a* opposite to the open end 5*c* thereof and that is connected at the other end to the grounding conductor portion 3. In the inverted-L-shaped antenna pattern 5 configured in this way, the grounding conductor pattern 5*b* is, like the grounding conductor pattern 1*c* of the inverted-F-shaped antenna pattern 1 shown in FIG. 4, formed so as to have a radially widening shape with a taper angle only on one side.

The inverted-L-shaped antenna pattern 5 is formed so as to overlap the inverted-F-shaped antenna pattern 1 with the circuit board 4, i.e. the material thereof, sandwiched in between in such a way that the elongate pattern 5*a* of the inverted-L-shaped antenna pattern 5 is located directly below the elongate pattern 1*a* of the inverted-F-shaped antenna pattern 1 and in addition that, as shown in the sectional view in FIG. 6, the grounding conductor pattern 5*b* of the inverted-L-shaped antenna pattern 5 is located directly below the feeding conductor, pattern 1*b* of the inverted-F-shaped antenna pattern 1.

Here, the path length Lp from the open end 5*c* of the elongate pattern 5*a* of the inverted-L-shaped antenna pattern 5 through the grounding conductor pattern 5*b* to the grounding conductor portion 3 is set to be slightly longer than the path length Li from the open end 1*d* of the elongate pattern 1*a* of the inverted-F-shaped antenna pattern 1 through the grounding conductor pattern 1*c* to the grounding conductor portion 3. More specifically, assuming that the effective wavelength of the antenna at the center frequency of the usable frequency range thereof is $\lambda$, the path lengths Li and Lp are so set as to fulfill $0.236\times\lambda \leqq Li < 0.25\times\lambda$ and $0.25\times\lambda \leqq Lp < 0.273\times\lambda$.

Moreover, as in the first embodiment, in the inverted-F-shaped antenna pattern 1 and the inverted-L-shaped antenna pattern 5, the preferred gap between the elongate pattern 1*a* or 5*a* and the grounding conductor portion 3 is $0.02\times\lambda$ or wider. Furthermore, considering the accuracy with which the patterns are formed, the preferred pattern line width of the inverted-F-shaped antenna pattern 1 and the inverted-L-shaped antenna pattern 5 constituting the pattern antenna is 0.5 mm or wider.

Formed as described above, the inverted-F-shaped and inverted-L-shaped antenna patterns 1 and 5 act respectively as a driven element to which electrical energy is fed and as a passive element that is driven by the inverted-F-shaped antenna pattern 1 acting as the driven element. Moreover, the path lengths of the inverted-F-shaped and inverted-L-shaped antenna patterns 1 and 5 are set to be two values that deviate from $0.25\times\lambda$ in opposite directions. As a result, when considered individually, the inverted-F-shaped and inverted-L-shaped antenna patterns 1 and 5 have their usable frequency ranges shifted to the low-frequency and high-frequency sides, respectively, of the center frequency of the usable frequency range of the pattern antenna as a whole, i.e. the frequency that corresponds to the effective wavelength $\lambda$ thereof.

The inverted-F-shaped and inverted-L-shaped antenna patterns 1 and 5, having their usable frequency ranges shifted to the low-frequency and high-frequency sides, respectively, of the center frequency of the usable frequency range of the pattern antenna as a whole, i.e. the frequency that corresponds to the effective wavelength $\lambda$ thereof, as described above, affect each other. As a result, in the pattern antenna configured as described above, the voltage standing wave ratio exhibits a frequency response as shown in FIG. 7, offering a wider frequency range in which VSWR <2 than is obtained in the first embodiment (FIG. 2) This makes it possible to achieve satisfactory impedance matching in a wide frequency range and thereby transmit and receive communication signals in a wide frequency range.

In this embodiment, the inverted-F-shaped and inverted-L-shaped antenna patterns have been described as having their grounding conductor and feeding conductor patterns formed to have a radially widening shape with a taper angle only on one side. However, these conductor patterns may be formed to have a radially widening shape with equal taper angles on both sides. The inverted-F-shaped antenna pattern may have only its feeding conductor pattern formed to have a tapered shape as in the first embodiment (FIG. 1).

Third Embodiment

Figure 8:
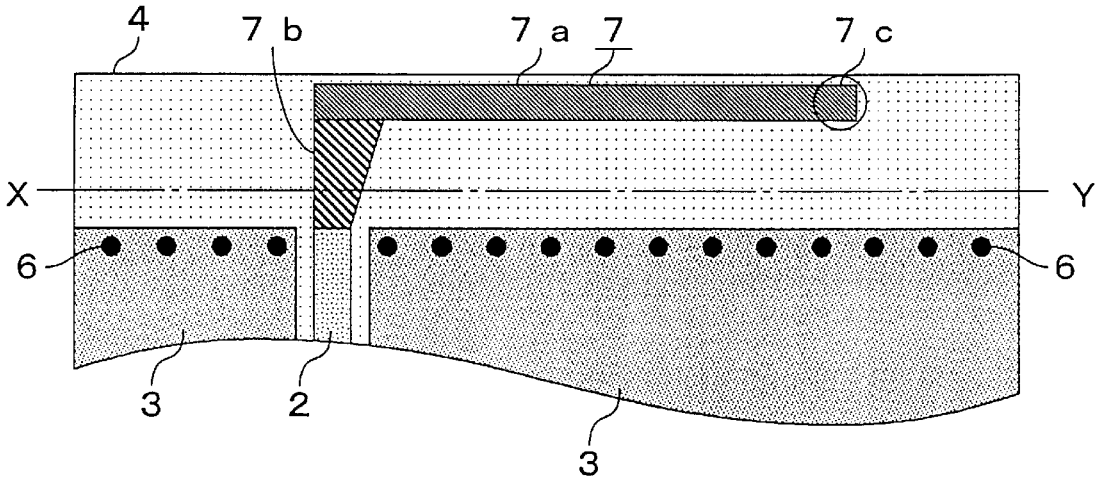
FIG. 8 is a plan view showing the configuration of one inverted-L-shaped antenna pattern in the pattern antenna of a third embodiment of the invention.
Figure 9:
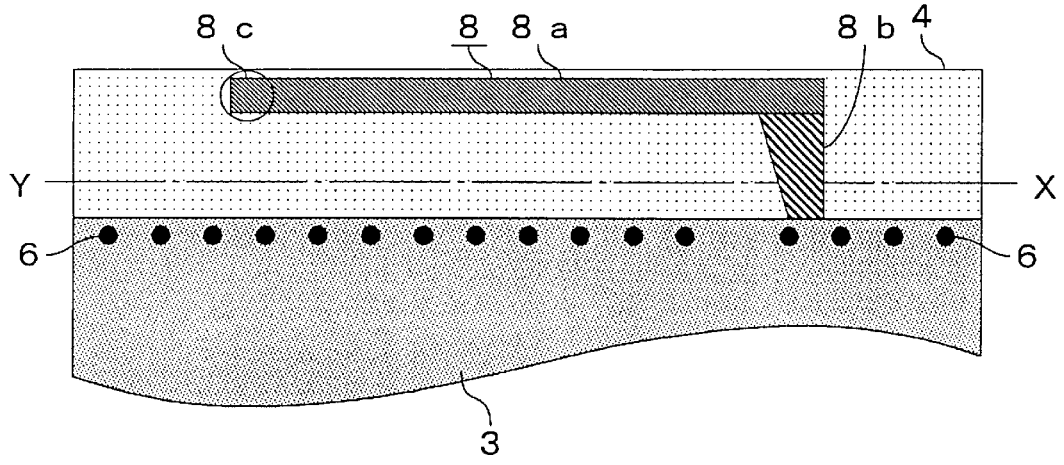
FIG. 9 is a plan view showing the configuration of the other inverted-L-shaped antenna pattern in the pattern antenna of the third embodiment.
Figure 10:
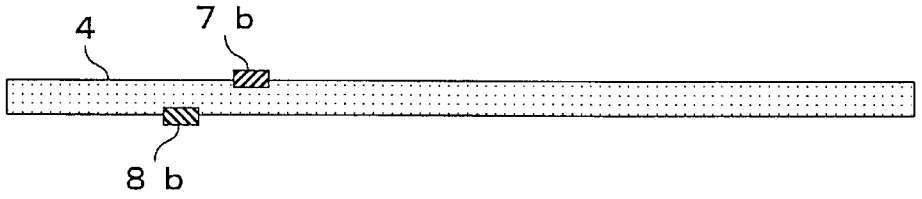
FIG. 10 is a sectional view showing the configuration of the pattern antenna of the third embodiment.
Figure 11:
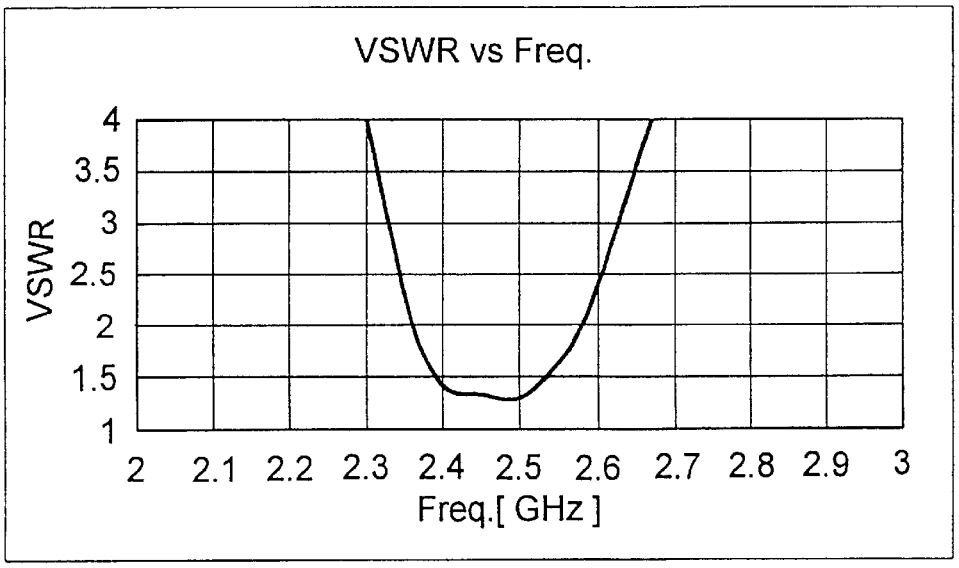
FIG. 11 is a diagram showing the frequency response of the voltage standing wave ratio of the pattern antenna of the third embodiment.

A third embodiment of the invention will be described below with reference to the drawings. FIG. 8 is a diagram showing the obverse-side surface of the pattern antenna of this embodiment. FIG. 9 is a diagram showing the reverse-side surface of the pattern antenna of this embodiment. FIG. 10 is a sectional view of the pattern antenna of this embodiment, taken along line X-Y shown in FIGS. 8 and 9. FIG. 11 is a graph showing the frequency response of the voltage standing wave ratio (VSWR) of the pattern antenna of this embodiment. Here, such elements as are used for the same purposes as in the pattern antenna of the second embodiment are identified with the same reference numerals, and their detailed explanations will not be repeated.

The pattern antenna of this embodiment is composed of an inverted-L-shaped antenna pattern 7 formed on the obverse-side surface of a glass-epoxy circuit board 4 as shown in FIG. 8 and an inverted-L-shaped antenna pattern 8 formed on the reverse-side surface of the circuit board 4 as shown in FIG. 9. The inverted-L-shaped antenna pattern 7 and the inverted-L-shaped antenna pattern 8 are formed in an edge portion of the circuit board 4, which has other circuit patterns and the like also formed thereon. On the obverse-side surface of the circuit board 4 are formed, as in the second embodiment (FIG. 4), a feeding transmission path 2 and a grounding conductor portion 3 with through holes 6 formed in a peripheral portion thereof. On the reverse-side surface of the circuit board 4 is formed, as in the second embodiment (FIG. 5), a grounding conductor portion 3 with through holes 6 formed in a peripheral portion thereof.

As shown in FIG. 8, the inverted-L-shaped antenna pattern 7 formed on the obverse-side surface of the circuit board 4 consists of an elongate pattern 7*a* that is formed parallel to a side edge of the grounding conductor portion 3 that faces it, and a feeding conductor pattern 7*b* that is connected at one end to the end of the elongate pattern 7*a* opposite to the open end 7*c* thereof and that is connected at the other end to the feeding transmission path 2. On the other hand, as shown in FIG. 9, the inverted-L-shaped antenna pattern 8 formed on the reverse-side surface of the circuit board 4 consists of, as in the second embodiment, an elongate pattern 8*a* that is formed parallel to a side edge of the grounding conductor portion 3 that faces it, and a grounding conductor pattern 8*b* that is connected at one end to the end of the elongate pattern 8*a* opposite to the open end 8*c* thereof and that is connected at the other end to the grounding conductor portion 3. The feeding conductor pattern 7*b* and the grounding conductor pattern 8*b* are, like the feeding conductor pattern 1*b* of the inverted-F-shaped antenna pattern 1 shown in FIG. 4 and the like, formed so as to have a radially widening shape with a taper angle only on one side.

The inverted-L-shaped antenna pattern 8 is formed so as to overlap the inverted-L-shaped antenna pattern 7 with the circuit board 4, i.e. the material thereof, sandwiched in between in such a way that the open end 8*c* of the inverted-L-shaped antenna pattern 8 is located directly below the open end 7*c* of the inverted-L-shaped antenna pattern 7 and in addition that, as shown in the sectional view in FIG. 10, the grounding conductor pattern 8*b* of the inverted-L-shaped antenna pattern 8 does not overlap the feeding conductor pattern 7*b* of the inverted-L-shaped antenna pattern 7.

Here, as in the second embodiment, the path length Lp from the open end 8*c* of the elongate pattern 8*a* of the inverted-L-shaped antenna pattern 8 through the grounding conductor pattern 8*b* to the grounding conductor portion 3 is set to be slightly longer than the path length Li from the open end 7*c* of the elongate pattern 7*a* of the inverted-L-shaped antenna pattern 7 through the feeding conductor pattern 7*b* to the feeding transmission path 2. More specifically, assuming that the effective wavelength of the antenna at the center frequency of the usable frequency range thereof is $\lambda$, the path lengths Li and Lp are so set as to fulfill $0.236\times\lambda \leqq Li < 0.25\times\lambda$ and $0.25\times\lambda \leqq Lp < 0.273\times\lambda$.

Moreover, as in the second embodiment, in the inverted-L-shaped antenna patterns 7 and 8, the preferred gap between the elongate pattern 7*a* or 8*a* and the grounding conductor portion 3 is $0.02\times\lambda$ or wider. Furthermore, considering the accuracy with which the patterns are formed, the preferred pattern line width of the inverted-L-shaped antenna patterns 7 and 8 constituting the pattern antenna is 0.5 mm or wider.

In the pattern antenna configured as described above, the inverted-L-shaped antenna pattern 7 acts as a driven element, and the inverted-L-shaped antenna pattern 8 acts as a passive element. As a result, in this pattern antenna, the voltage standing wave ratio exhibits a frequency response as shown in FIG. 11, offering, as in the second embodiment (FIG. 7), a wider frequency range in which VSWR <2 than is obtained in the first embodiment (FIG. 2). This makes it possible to achieve satisfactory impedance matching in a wide frequency range and thereby transmit and receive communication signals in a wide frequency range.

In this embodiment, the inverted-L-shaped antenna patterns have been described as having their grounding conductor and feeding conductor patterns formed to have a radially widening shape with a taper angle only on one side. However, these conductor patterns may be formed to have a radially widening shape with equal taper angles on both sides.

Fourth Embodiment

Figure 12:
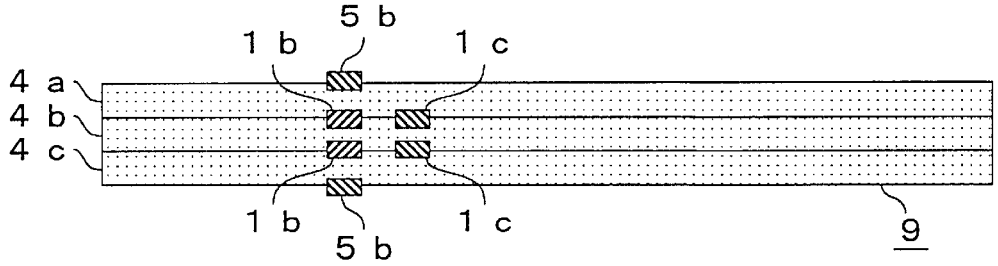
FIG. 12 is a sectional view showing the configuration of the pattern antenna of a fourth embodiment of the invention.

A fourth embodiment of the invention will be described below with reference to the drawings. FIG. 12 is a sectional view of the pattern antenna of this embodiment. Here, such elements as are used for the same purposes as in the pattern antenna of the second embodiment are identified with the same reference numerals, and their detailed explanations will not be repeated. It is to be noted that the sectional view of FIG. 12 is, like FIG. 6, a sectional view taken along line X-Y shown in FIGS. 4 and 5.

As shown in FIG. 12, the pattern antenna of this embodiment is formed on and in a multilayer glass-epoxy circuit board 9 composed of three layers of glass-epoxy circuit boards 4*a*, 4*b*, and 4*c* (these circuit boards 4*a*, 4*b*, and 4*c* correspond to the circuit board 4). In the following descriptions, these circuit boards are called, from the top down, the first-layer circuit board 4*a*, the second-layer circuit board 4*b*, and the third-layer circuit board 4*c*. The multilayer circuit board 9 configured in this way has, like the circuit board 4 of the second embodiment, other circuit patterns also formed thereon.

In this multilayer circuit board 9, on each of the obverse-side surfaces of the second-layer and third-layer circuit boards 4*b* and 4*c*, an inverted-F-shaped antenna pattern 1 as shown in FIG. 4 is formed, and, on each of the obverse-side surface of the first-layer circuit board 4*a* and the reverse-side surface of the third-layer circuit board 4*c*, an inverted-L-shaped antenna pattern 5 is formed. The shape of the inverted-L-shaped antenna pattern shown in FIG. 5 corresponds to the shape of the inverted-L-shaped antenna pattern 5 formed on the obverse-side surface of the first-layer circuit board 4*a* as seen through the first-layer circuit board 4*a* from the reverse-side surface thereof.

The inverted-F-shaped antenna patterns 1 and the inverted-L-shaped antenna patterns 5 are formed in an edge portion of the multilayer circuit board 9, which has other circuit patterns and the like also formed thereon. On each of the obverse-side surfaces of the second-layer and third-layer circuit boards 4*b* and 4*c* are formed, as in the second embodiment (FIG. 4), a feeding transmission path 2 and a grounding conductor portion 3 with through holes 6 formed in a peripheral portion thereof. On the other hand, on each of the obverse-side surface of the first-layer circuit board 4*a* and the reverse-side surface of the third-layer circuit board 4*c* is formed, as in the second embodiment (FIG. 5), a grounding conductor portion 3 with through holes 6 formed in a peripheral portion thereof.

On each layer of this multilayer circuit board 9, the inverted-F-shaped antenna pattern 1 and the inverted-L-shaped antenna pattern 5 are, as in the first embodiment, so formed that their respective elongate patterns 1*a* and 5*a*, which are formed parallel to a side edge of the grounding conductor portion 3 that faces it, overlap each other with the material of the circuit board 9 sandwiched in between and in addition that the feeding conductor pattern 1*b* of the former, which is connected to the feeding transmission path 2, and the grounding conductor pattern 5*b* of the latter, which is connected to the grounding conductor portion 3, overlap each other with the material of the circuit board 9 sandwiched in between.

The inverted-F-shaped antenna patterns 1 and the inverted-L-shaped antenna patterns 5 constituting the pattern antenna of this embodiment have the same features as their counterparts in the second embodiment, and therefore their detailed explanations will not be repeated, as given previously in connection with the second embodiment.

In a pattern antenna built by combining together a plurality of inverted-F-shaped antenna patterns and a plurality of inverted-L-shaped antenna patterns in this way, the voltage standing wave ratio exhibits a frequency response such that the maximum of the voltage standing wave ratio around the usable frequency range is lower than in the second embodiment (FIG. 4). This makes it possible to achieve better impedance matching in a wide frequency range in which VSWR <2 and thereby transmit and receive communication signals in a wide frequency range.

This embodiment deals with an example in which the pattern antenna is composed of a plurality of inverted-F-shaped antenna patterns and a plurality of inverted-L-shaped antenna patterns. However, it is also possible to build the pattern antenna by forming on and in the multilayer circuit board 9 a plurality of inverted-L-shaped antenna patterns like the one 7 acting as a driven element in the third embodiment and a plurality of inverted-L-shaped antenna patterns like the one 8 acting as a passive element in the third embodiment. In the multilayer circuit board 9, the antenna patterns acting as driven elements and the antenna patterns acting as passive elements may be formed in any other manner than is specifically shown in the sectional view of FIG. 12 in terms of the order in which they overlap one another and in other aspects; for example, the pattern antenna may be composed of one driven element and a plurality of passive elements having different path lengths.

Fifth Embodiment

Figure 13:
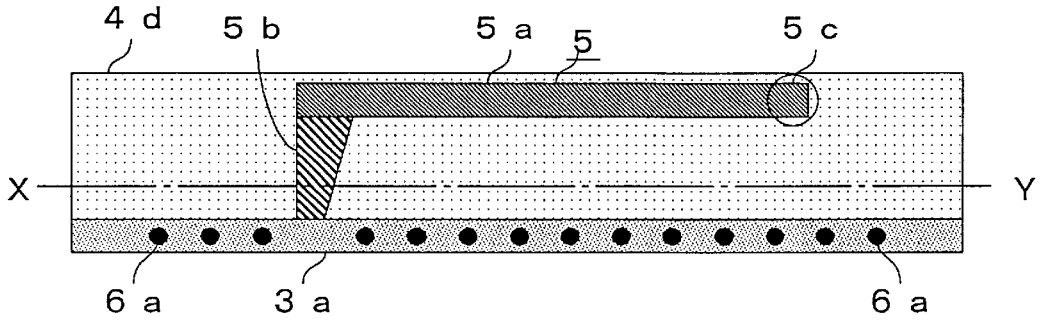
FIG. 13 is a plan view showing the configuration of the inverted-L-shaped antenna pattern in the pattern antenna of a fifth embodiment of the invention.
Figure 14:
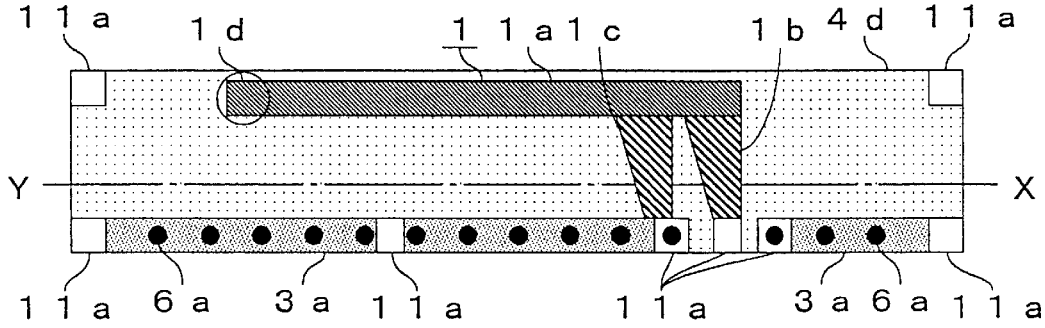
FIG. 14 is a plan view showing the configuration of the inverted-F-shaped antenna pattern in the pattern antenna of the fifth embodiment.
Figure 15:
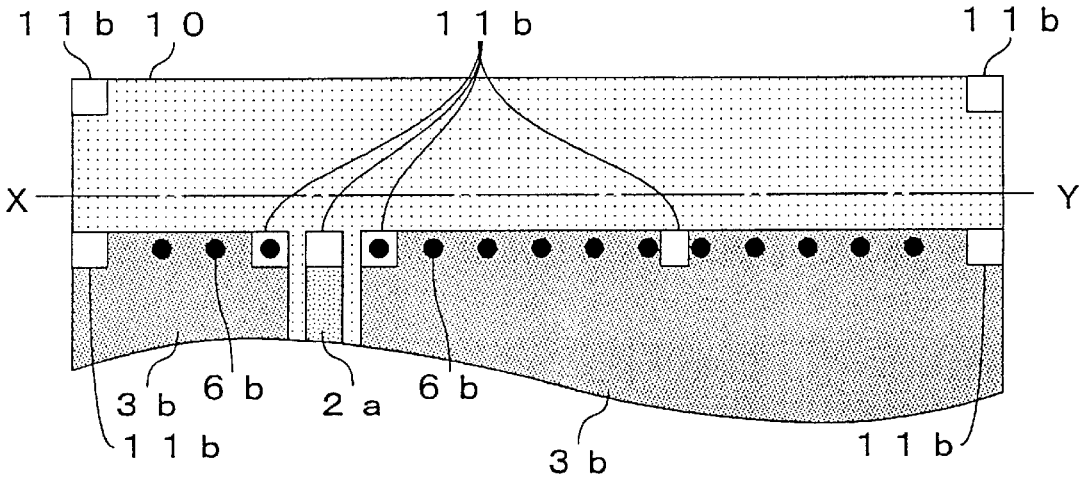
FIG. 15 is a plan view showing the configuration of the surface of the circuit board on which the pattern antenna of the fifth embodiment is formed.
Figure 16:
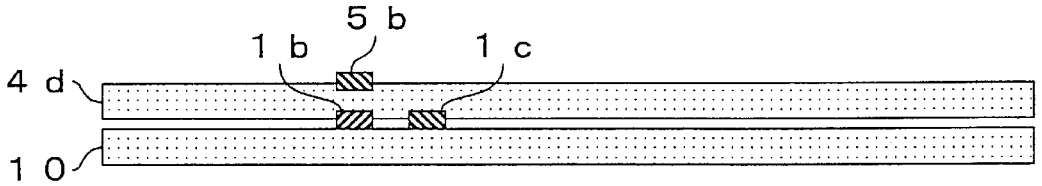
FIG. 16 is a sectional view showing the configuration of the pattern antenna of the fifth embodiment.

A fifth embodiment of the invention will be described below with reference to the drawings. FIG. 13 is a diagram showing the obverse-side surface of the pattern antenna of this embodiment. FIG. 14 is a diagram showing the reverse-side surface of the pattern antenna of this embodiment. FIG. 15 is a diagram showing the obverse-side surface, together with the land patterns formed thereon, of the circuit board on which the pattern antenna of this embodiment is mounted. FIG. 16 is a sectional view of the pattern antenna of this embodiment, taken along line X-Y shown in FIGS. 13 to 15. Here, such elements as are used for the same purposes as in the pattern antenna of the second embodiment are identified with the same reference numerals, and their detailed explanations will not be repeated.

As opposed to the pattern antennas of the first to fourth embodiments, which are formed on the same circuit board on which other circuit patterns and the like are formed, the pattern antenna of this embodiment is formed on a circuit board separate from a circuit board on which other circuit patterns and the like are formed, and the circuit board on which the pattern antenna is formed is mounted on the circuit board on which the other circuit patterns and the like are formed.

Specifically, the pattern antenna of this embodiment is composed of an inverted-L-shaped antenna pattern 5 formed on the obverse-side surface of a glass-epoxy circuit board 4*d* as shown in FIG. 13, and an inverted-F-shaped antenna pattern 1 formed on the reverse-side surface of the circuit board 4*d* as shown in FIG. 14. As shown in FIG. 13, on the obverse-side surface of the circuit board 4*d* is formed a strip-shaped grounding conductor portion 3*a*. As shown in FIG. 14, on the reverse-side surface of the circuit board 4*d* are formed two strip-shaped grounding conductor portions 3*a* and a plurality of land marks 11*a* for electrical connection with relevant portions of another circuit board 10 described later.

Here, as in the second embodiment (FIGS. 4 and 5), the grounding conductor portions 3*a* formed on the obverse-side and reverse-side surfaces of the circuit board 4*d* are so formed as to overlap each other with the circuit board 4*d*, i.e. the material thereof, sandwiched in between, and these grounding conductor portions 3*a* have through holes 6*a* formed therein. The land marks 11*a* formed on the reverse-side surface of the circuit board 4*d* are located in the four corners of the circuit board 4*d*, on the grounding conductor portions 3*a*, and between the two grounding conductor portions 3*a*.

The inverted-F-shaped antenna pattern 1 and the inverted-L-shaped antenna pattern 5 formed on the circuit board 4*d* as described above are, like the inverted-F-shaped antenna pattern and the inverted-L-shaped antenna pattern formed on the circuit board in the first embodiment, so formed that their respective elongate patterns 1*a* and 5*a*, and the feeding conductor pattern 1*b* of the former and the grounding conductor pattern 5*b* of the latter, overlap each other with the circuit board 4*d*, i.e. with the material thereof, sandwiched in between. Moreover, in the inverted-F-shaped antenna pattern 1 formed in this way, the feeding conductor pattern 1*b* is connected to the land pattern 11*a* that is located at the spot between the two grounding conductor portions 3*a*.

The inverted-F-shaped antenna pattern 1 and the inverted-L-shaped antenna pattern 5 constituting the pattern antenna of this embodiment have the same features as their counterparts in the second embodiment, and therefore their detailed explanations will not be repeated, as given previously in connection with the second embodiment.

The pattern antenna built by forming the inverted-F-shaped antenna pattern 1 and the inverted-L-shaped antenna pattern 5 on the circuit board 4*d* in this way is mounted on the surface of another circuit board 10. This circuit board 10 will be described below with reference to FIG. 15. On the obverse-side surface of the circuit board 10, as on the circuit board 4 of the second embodiment (FIG. 3), two grounding conductor portions 3*b* are formed with through holes 6 formed therein, and, between those two grounding conductor portions 3*b*, a feeding transmission path 2*a* is formed.

Moreover, for electrical connection with the land patterns 11*a* formed on the reverse-side surface of the circuit board 4*d*, land patterns 11*b* are formed in corners of the circuit board 10, on the grounding conductor portions 3*b*, and on the feeding transmission path 2*a*. Thus, the pattern antenna is mounted on the circuit board 10 in such a way that the land patterns 11*a* formed on the circuit board 4*d*, specifically on the grounding conductor portions 3*a* and between the grounding conductor portions 3*a*, overlap the land patterns 11*b* formed on the circuit board 10, specifically on the grounding conductor portions 3*b* and on the feeding transmission path 2*a*.

As a result of this mounting, the grounding conductor portions 3*a* on the reverse-side surface of the circuit board 4*d* and the grounding conductor portions 3*b* on the obverse-side surface of the circuit board 10, and thus the through holes 6*a* formed in the grounding conductor portions 3*a* and the through holes 6*b* formed in the grounding conductor portions 3*b*, overlap each other. Moreover, in the inverted-F-shaped antenna pattern 1, the feeding conductor pattern 1*b* is electrically connected to the feeding transmission path 2*a* by way of the land patterns 11*a* and 11*b*, and the grounding conductor pattern 1*c* is electrically connected to the grounding conductor portions 3*b* by way of the grounding conductor portion 3*a* and the land patterns 11*a* and 11*b*. Furthermore, in the inverted-L-shaped antenna pattern 5, the grounding conductor pattern 5*b* is electrically connected to the grounding conductor portions 3*b* by way of the grounding conductor portion 3*a*, the through holes 6*a*, and the land patterns 11*a* and 11*b*.

When the pattern antenna is mounted on the circuit board 10 in this way, the circuit board 10, the glass-epoxy circuit board 4*d*, the inverted-F-shaped antenna pattern 1, and the inverted-L-shaped antenna pattern 5 are arranged as shown in a sectional view in FIG. 16. Specifically, the inverted-F-shaped antenna pattern 1 is formed between the obverse-side surface of the circuit board 10 and the reverse-side surface of the glass-epoxy circuit board 4*d*, and the inverted-L-shaped antenna pattern 5 is formed on the obverse-side surface of the glass-epoxy circuit board 4*d*.

In this embodiment, the pattern antenna that is mounted on another circuit board has a configuration similar to that of the pattern antenna of the second embodiment. However, it is also possible to mount a pattern antenna having a configuration similar to that of the pattern antenna of the first, third, or fourth embodiment on another circuit board.

Figure 17A:
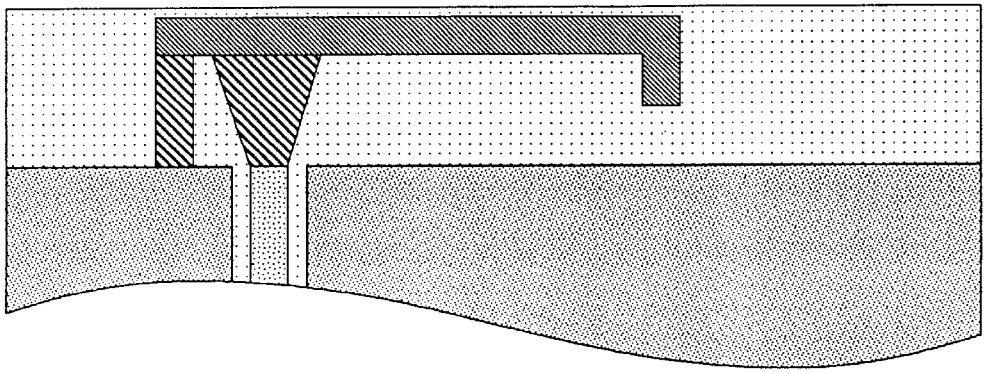
FIGS. 17A and 17B are plan views showing the configurations of antenna patterns with a hook-shaped and a meandering pattern, respectively.
Figure 17B:
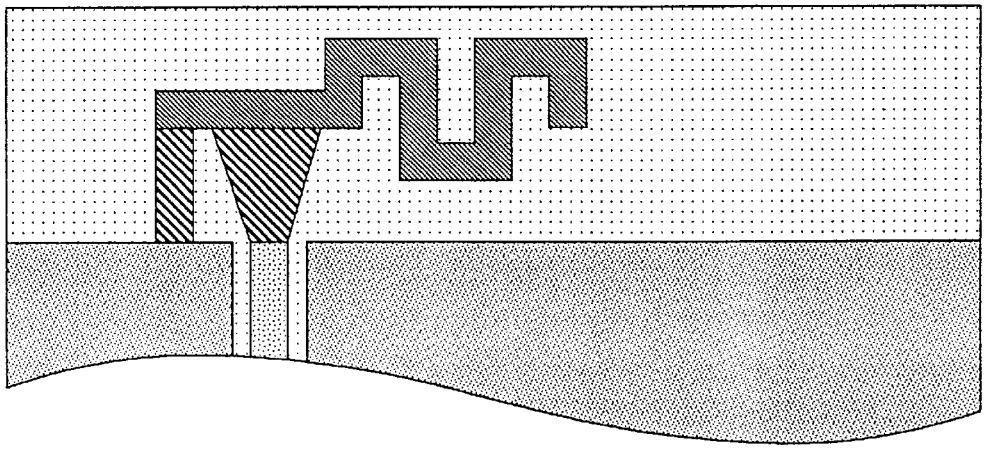

The first to fifth embodiments deal with examples in which the inverted-F-shaped and inverted-L-shaped antenna patterns have rectilinear elongate patterns. However, those antenna patterns may be formed in any other shape than is specifically described above, for example, they may have a hook-shaped pattern with the open end of the elongate pattern bent perpendicularly toward the grounding conductor portion as shown in FIG. 17A, or a meandering pattern with an open-end portion of the elongate pattern bent in a meandering shape as shown in FIG. 17B. These arrangements help reduce the area of the region that needs to be secured for each antenna pattern and thereby make the antenna as a whole compact. Although FIGS. 17A and 17B show driven elements each provided with a feeding conductor pattern and a grounding conductor pattern, similar arrangements may also be applied to a driven element provided only with a feeding conductor pattern, or to a passive element provided only with a grounding conductor pattern.

Figure 18A:
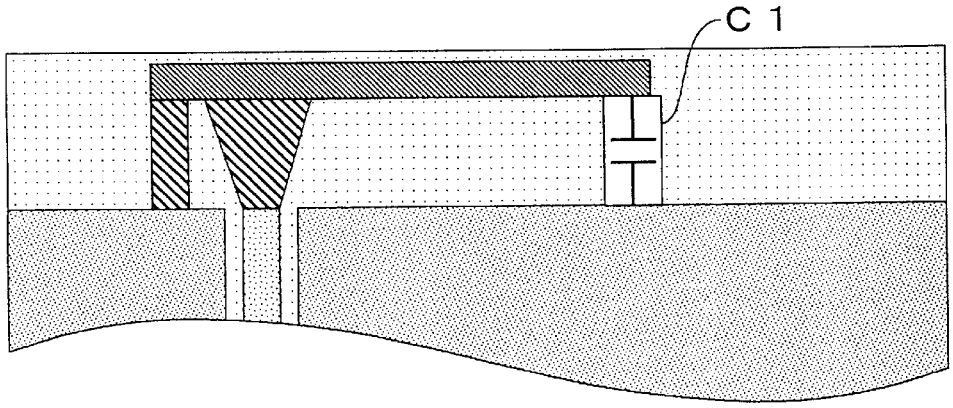
FIGS. 18A and 18B are plan views showing the configurations of antenna patterns with a chip capacitor placed thereon.
Figure 18B:
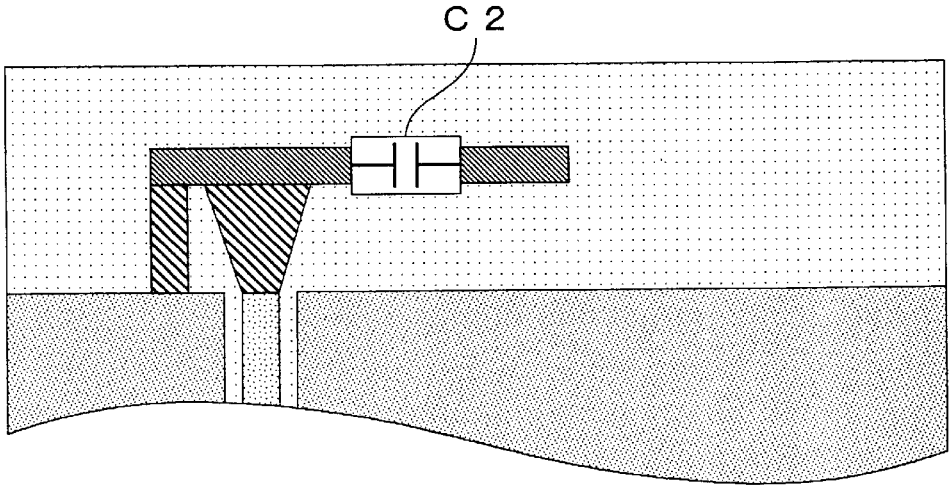

It is also possible to place a chip capacitor C1 between the open end of the elongate pattern and the grounding conductor portion as shown in FIG. 18A, or to divide the elongate pattern into two parts and place a chip capacitor C2 between them as shown in FIG. 18B. Placing a chip capacitor C1 or C2, which provides capacitance, in this way helps shorten the path length of each antenna pattern. This helps reduce the area of the region that needs to be secured for each antenna pattern and thereby make the antenna as a whole compact. Although FIGS. 18A and 18B show driven elements each provided with a feeding conductor pattern and a grounding conductor pattern, similar arrangements may also be applied to a driven element provided only with a feeding conductor pattern, or to a passive element provided only with a grounding conductor pattern.

In the embodiments, the pattern antenna is formed on a glass-epoxy circuit board, which has a comparatively low dielectric constant. However, for example, in antennas for transmitting and receiving high-frequency signals having frequencies of 3 GHz or above, it is also possible to use a Teflon-glass circuit board, which offers a still lower dielectric constant and a low dielectric loss.

The individual antenna patterns, i.e. the inverted-F-shaped and inverted-L-shaped antenna patterns, are formed by a patterning process based on etching, printing, or the like just as circuit patterns are formed on ordinary circuit boards.

Figure 19:
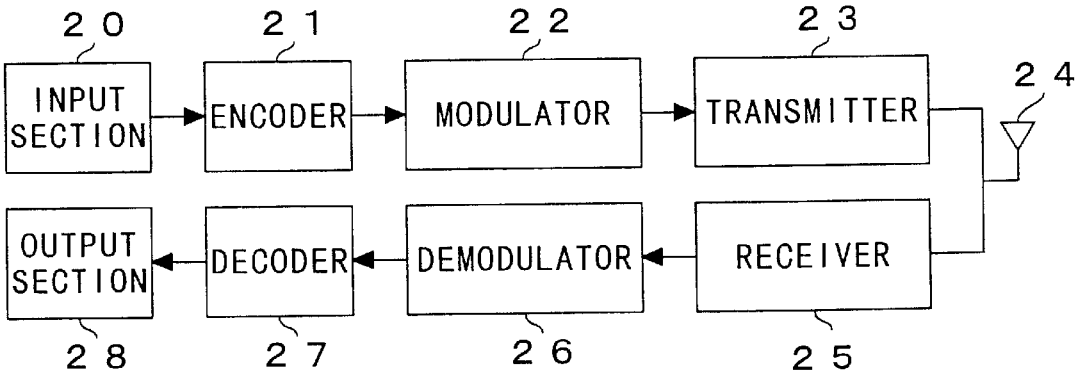
FIG. 19 is a block diagram showing an example of the internal configuration of a wireless communication device embodying the invention.
Figure 20A:
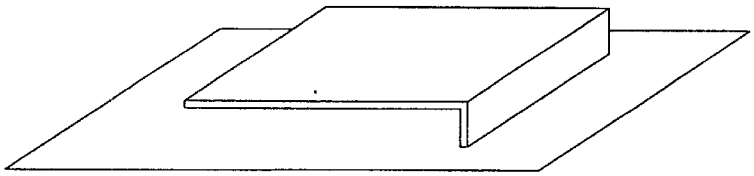
FIGS. 20A and 20B are external perspective views showing the configurations of conventional microstrip antennas.
Figure 20B:
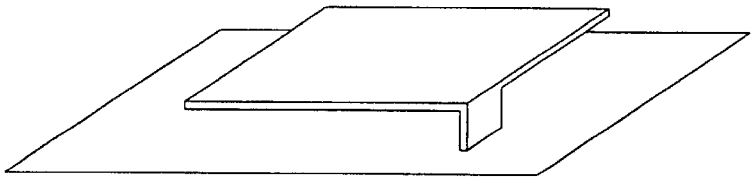
Figure 21:
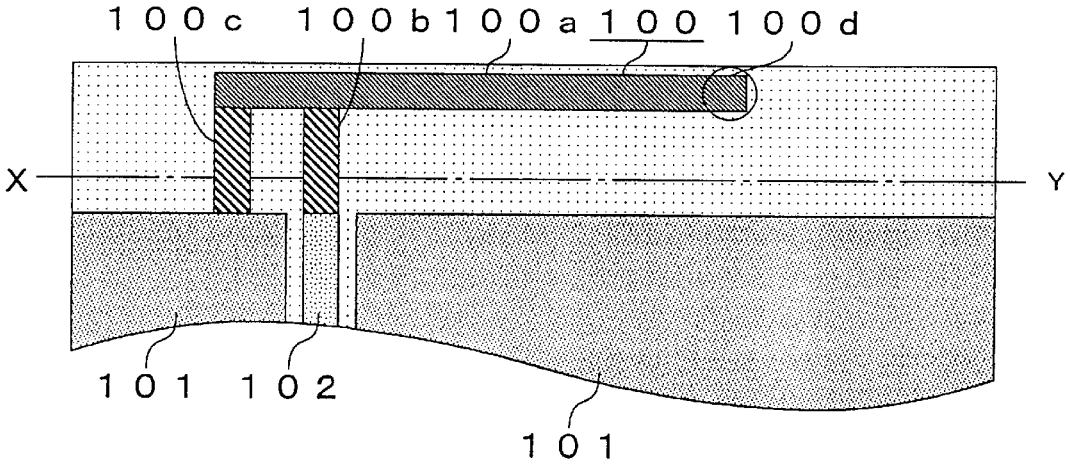
FIG. 21 is a plan view showing the configuration of a conventional inverted-F-shaped printed pattern antenna.
Figure 22:
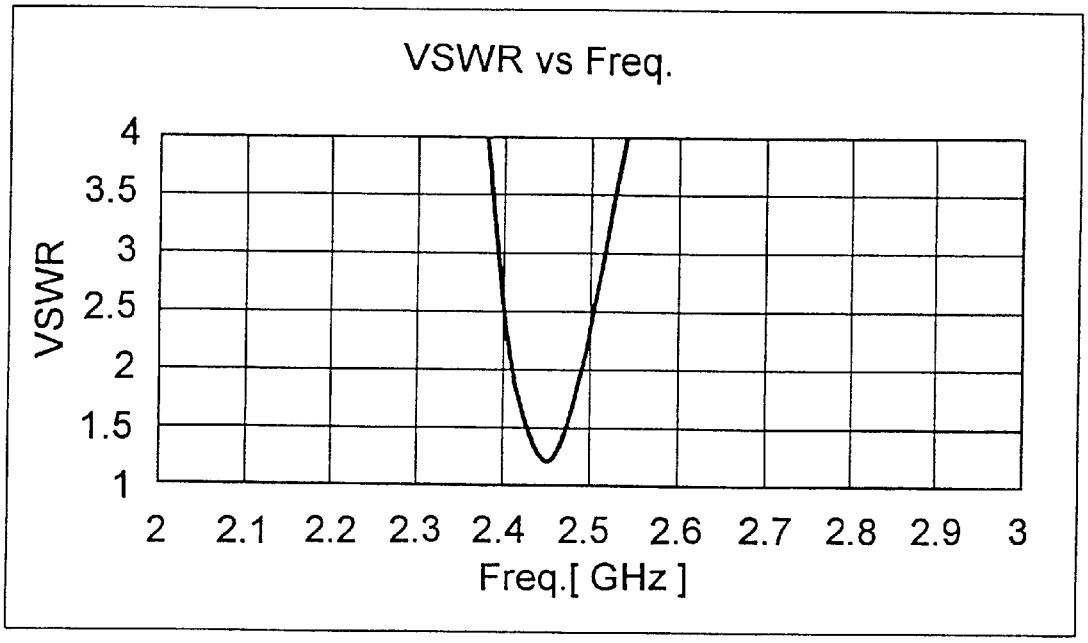
FIG. 22 is a diagram showing the frequency response of the voltage standing wave ratio of a conventional inverted-F-shaped antenna.

An Example of a Wireless Communication Device Equipped With an Antenna Embodying the Invention Hereinafter, a wireless communication device equipped with an antenna configured as in one of the first to fifth embodiments will be described. FIG. 19 is a block diagram showing the internal configuration of the wireless communication device of this embodiment.

The wireless communication device shown in FIG. 19 has an input section 20 to which sound, images, or data is fed from an external device, an encoder circuit 21 for encoding the data fed to the input section 20, a modulator circuit 22 for modulating the data encoded by the encoder circuit 21, a transmitter circuit 23 for amplifying the signal modulated by the modulator circuit 22 to produce a stable signal to be transmitted, an antenna 24 for transmitting and receiving signals, a receiver circuit 25 for amplifying the signals received by the antenna 24 and permitting only the signal within a predetermined frequency range to pass through, a demodulator circuit 26 for detecting and thereby demodulating the received signal amplified by the receiver circuit 25, a decoder circuit 27 for decoding the signal fed from the demodulator circuit 26, and an output section 28 for outputting the sound, images, or data decoded by the decoder circuit 27.

In this wireless communication device, first, the sound, images, or data fed to the input section 20 such as a microphone, a camera, or a keyboard is encoded by the encoder circuit 21. Then, by the modulator circuit 22, the encoded data is modulated with a carrier wave having a predetermined frequency. Then, the modulated signal is amplified by the transmitter circuit 23. The signal is then radiated as a transmitted signal by the antenna 24, which is configured as a pattern antenna like those of the first to fifth embodiments described previously.

On the other hand, when signals are received by the antenna 24, first, the signals are amplified by the receiver circuit 25, and, by a filter circuit or the like provided in this receiver circuit 25, only the signal within a predetermined frequency range is permitted to pass through, and is thus fed to the demodulator circuit 26. Then, the demodulator circuit 26 detects and thereby demodulates the signal fed from the receiver circuit 25, and then the demodulated signal is decoded by the decoder circuit 27. The sound, images, or data obtained as a result of the decoding by the decoder circuit 27 is then output to the output section 28 such as a loudspeaker or a display.

In this wireless communication device, when a pattern antenna like those of the first to fourth embodiments is used as the antenna 24, on the same circuit board on which the antenna 24 is formed, the encoder circuit 21, modulator circuit 22, transmitter circuit 23, receiver circuit 25, demodulator circuit 26, decoder circuit 27 are also formed as circuit patterns. On the other hand, when a pattern antenna like that of the fifth embodiment is used as the antenna 24, the circuit board on which the antenna 24 is formed is mounted on another circuit board on which the encoder circuit 21, modulator circuit 22, transmitter circuit 23, receiver circuit 25, demodulator circuit 26, decoder circuit 27 are formed as circuit patterns, with the land patterns formed on the two circuit boards connected together.

The embodiment described just above deals with an example of a wireless communication device in which the pattern antenna of one of the first to fifth embodiments described earlier is used as an antenna for both transmission and reception. However, the pattern antenna of any of those embodiments may be used as an antenna for reception only in a wireless receiver device, or as an antenna for transmission only in a wireless transmitter device.

According to the present invention, a pattern antenna is composed of antenna patterns. This eliminates the need to secure a three-dimensional space as required by a conventional antenna, and in addition, by bending the antenna patterns constituting the antenna, it is possible to reduce the area of the region that needs to be secured to form those antenna patterns. This not only helps miniaturize antennas themselves, but also contributes to the miniaturization of wireless communication devices that incorporate pattern antennas embodying the invention. Moreover, by forming feeding and grounding patterns in a tapered shape, it is possible to achieve impedance matching in a wide frequency range, and thus realize an antenna that can transmit and receive signals in a wide frequency range.

What is claimed is:

1. A pattern antenna formed on a circuit board, comprising:

an inverted-F-shaped antenna pattern formed on a surface of the circuit board, having one end serving as a feeding portion and another end left as an open end, having a bent portion formed between the feeding portion and the open end, with a portion of the inverted-F-shaped antenna pattern between the feeding portion and the bent portion serving as a feeding conductor pattern, and having a grounding conductor pattern formed so as to extend from a point between the feeding portion and the open end, wherein at least one of the feeding conductor pattern and the grounding conductor pattern is formed so as to have a trapezoid shape.

2. A pattern antenna as claimed in claim 1, wherein, in the antenna pattern, the feeding conductor pattern or the grounding conductor pattern is formed as a trapezoid-shaped pattern whose width increases away from a feeding line or grounding conductor portion formed on the circuit board.

3. A pattern antenna as claimed in claim 1, wherein, in the antenna pattern, a pattern formed between the open end and the bent portion is a hook-shaped pattern with a bend formed at the open end or a pattern of which a part is bent in a meandering shape.

4. A pattern antenna as claimed in claim 1, wherein a chip capacitor is placed on the antenna pattern.

5. A pattern antenna as claimed in claim 1, wherein the antenna pattern is formed in an edge portion of the circuit board.

6. A pattern antenna as claimed in claim 1, wherein the circuit board is a glass-epoxy or Teflon-glass circuit board.

7. A pattern antenna as claimed in claim 1, wherein a pattern of another circuit is formed on the circuit board.

8. A pattern antenna as claimed in claim 1, wherein a land pattern is formed on the circuit board for electrical connection with another circuit board.

9. A pattern antenna formed on a circuit board, comprising:

an inverted-L-shaped antenna pattern formed on a surface of the circuit board, having one end serving as a feeding portion and another end left as an open end, and having a bent portion formed between the feeding portion and the open end, with a portion of the inverted-L-shaped antenna pattern between the feeding portion and the bent portion serving as a feeding conductor pattern, wherein the feeding conductor pattern is formed so as to have a trapezoid shape.

10. A pattern antenna as claimed in claim 9, wherein, in the antenna pattern, the feeding conductor pattern is formed as a trapezoid-shaped pattern whose width increases away from a feeding line formed on the circuit board.

11. A pattern antenna as claimed in claim 9, wherein, in the antenna pattern, a pattern formed between the open end and the bent portion is a hook-shaped pattern with a bend formed at the open end or a pattern of which a part is bent in a meandering shape.

12. A pattern antenna as claimed in claim 9, wherein a chip capacitor is placed on the antenna pattern.

13. A pattern antenna as claimed in claim 9, wherein the antenna pattern is formed in an edge portion of the circuit board.

14. A pattern antenna as claimed in claim 9, wherein the circuit board is a glass-epoxy or Teflon-glass circuit board.

15. A pattern antenna as claimed in claim 9, wherein a pattern of another circuit is formed on the circuit board.

16. A pattern antenna as claimed in claim 9, wherein a land pattern is formed on the circuit board for electrical connection with another circuit board.

17. A pattern antenna formed on a circuit board, comprising:

a first, inverted-F-shaped antenna pattern formed on a first surface of the circuit board, having one end serving as a feeding portion and another end left as an open end, having a bent portion formed between the feeding portion and the open end, with a portion of the first antenna pattern between the feeding portion and the bent portion serving as a feeding conductor pattern, and having a grounding conductor pattern formed so as to extend from a point between the feeding portion and the open end, wherein at least one of the feeding conductor pattern and the grounding conductor pattern is formed so as to have a trapezoid shape; and a second, inverted-L-shaped antenna pattern formed on a second surface of the circuit board, having one end serving as a grounding portion and another end left as an open end, and having a bent portion formed between the grounding portion and the open end, with a portion of the second antenna pattern between the grounding portion and the bent portion serving as a grounding conductor pattern, wherein the grounding conductor pattern is formed so as to have a trapezoid shape.

18. A pattern antenna as claimed in claim 17, wherein, in the antenna patterns, said one of the feeding conductor pattern and the grounding conductor pattern of the first antenna pattern or the grounding conductor pattern of the second antenna pattern is formed as a trapezoid-shaped pattern whose width increases away from a feeding line or grounding conductor portion formed on the circuit board.

19. A pattern antenna as claimed in claim 17, wherein the first and second antenna patterns are formed so as to overlap each other with a material of the circuit board sandwiched in between.

20. A pattern antenna formed on a circuit board, comprising:

a first, inverted-L-shaped antenna pattern formed on a first surface of the circuit board, having one end serving as a feeding portion and another end left as an open end, and having a bent portion formed between the feeding portion and the open end, with a portion of the first antenna pattern between the feeding portion and the bent portion serving as a feeding conductor pattern, wherein the feeding conductor pattern is formed so as to have a trapezoid shape; and a second, inverted-L-shaped antenna pattern formed on a second surface of the circuit board, having one end serving as a grounding portion and another end left as an open end, and having a bent portion formed between the grounding portion and the open end, with a portion of the second antenna pattern between the grounding portion and the bent portion serving as a grounding conductor pattern, wherein the grounding conductor pattern is formed so as to have a trapezoid shape.

21. A pattern antenna as claimed in claim 20, wherein, in the antenna patterns, the feeding conductor pattern of the first antenna pattern or the grounding conductor pattern of the second antenna pattern is formed as a trapezoid-shaped pattern whose width increases away from a feeding line or grounding conductor portion formed on the circuit board.

22. A pattern antenna as claimed in claim 20, wherein the first and second antenna patterns are formed so as to overlap each other with a material of the circuit board sandwiched in between.

23. A pattern antenna formed on and in a multilayer circuit board, comprising a plurality of first, inverted-F-shaped antenna patterns each formed on a surface of a layer or at an interface between layers constituting the multilayer circuit board, having one end serving as a feeding portion and another end left as an open end, having a bent portion formed between the feeding portion and the open end, with a portion of the first antenna pattern between the feeding portion and the bent portion serving as a feeding conductor pattern, and having a grounding conductor pattern formed so as to extend from a point between the feeding portion and the open end, wherein at least one of the feeding conductor pattern and the grounding conductor pattern is formed so as to have a trapezoid shape; and a plurality of second, inverted-L-shaped antenna patterns each formed on a surface of a layer or at an interface between layers constituting the multilayer circuit board, having one end serving as a grounding portion and another end left as an open end, and having a bent portion formed between the grounding portion and the open end, with a portion of the second antenna pattern between the grounding portion and the bent portion serving as a grounding conductor pattern, wherein the grounding conductor pattern is formed so as to have a trapezoid shape.

24. A pattern antenna as claimed in claim 23, wherein, in the antenna patterns, said one of the feeding conductor pattern and the grounding conductor pattern of each of the first antenna patterns or the grounding conductor pattern of each of the second antenna patterns is formed as a trapezoid-shaped pattern whose width increases away from a feeding line or grounding conductor portion formed on or in the multilayer circuit board.

25. A pattern antenna as claimed in claim 23, wherein the first and second antenna patterns are formed so as to overlap each other with a material of the circuit board sandwiched in between.

26. A pattern antenna as claimed in claim 23, wherein the first and second antenna patterns are all formed on different surfaces of the layers constituting the multilayer circuit board.

27. A pattern antenna formed on and in a multilayer circuit board, comprising a plurality of first, inverted-L-shaped antenna patterns each formed on a surface of a layer or at an interface between layers constituting the multilayer circuit board, having one end serving as a feeding portion and another end left as an open end, and having a bent portion formed between the feeding portion and the open end, with a portion of the first antenna pattern between the feeding portion and the bent portion serving as a feeding conductor pattern, wherein the feeding conductor pattern is formed so as to have a trapezoid shape; and a plurality of second, inverted-L-shaped antenna patterns each formed on a surface of a layer or at an interface between layers constituting the multilayer circuit board, having one end serving as a grounding portion and another end left as an open end, and having a bent portion formed between the grounding portion and the open end, with a portion of the second antenna pattern between the grounding portion and the bent portion serving as a grounding conductor pattern, wherein the grounding conductor pattern is formed so as to have a trapezoid shape.

28. A pattern antenna as claimed in claim 27, wherein, in the antenna patterns, the feeding conductor pattern of each of the first antenna pattern or the grounding conductor pattern of each of the second antenna pattern is formed as a trapezoid-shaped pattern whose width increases away from a feeding line or grounding conductor portion formed on or in the multilayer circuit board.

29. A pattern antenna as claimed in claim 27, wherein the first and second antenna patterns are formed so as to overlap each other with a material of the circuit board sandwiched in between.

30. A pattern antenna as claimed in claim 27, wherein the first and second antenna patterns are all formed on different surfaces of the layers constituting the multilayer circuit board.

31. A wireless communication device comprising a pattern antenna that permits at least either transmission or reception of a communication signal to or from an external device, the pattern antenna comprising:

an inverted-F-shaped antenna pattern formed on a surface of the circuit board, having one end serving as a feeding portion and another end left as an open end, having a bent portion formed between the feeding portion and the open end, with a portion of the inverted-F-shaped antenna pattern between the feeding portion and the bent portion serving as a feeding conductor pattern, and having a grounding conductor pattern formed so as to extend from a point between the feeding portion and the open end, wherein at least one of the feeding conductor pattern and the grounding conductor pattern is formed so as to have a trapezoid shape.

32. A wireless communication device comprising a pattern antenna that permits at least either transmission or reception of a communication signal to or from an external device, the pattern antenna comprising:

an inverted-L-shaped antenna pattern formed on a surface of the circuit board, having one end serving as a feeding portion and another end left as an open end, and having a bent portion formed between the feeding portion and the open end, with a portion of the inverted-L-shaped antenna pattern between the feeding portion and the bent portion serving as a feeding conductor pattern, wherein the feeding conductor pattern is formed so as to have a trapezoid shape.

33. A wireless communication device comprising a pattern antenna that permits at least either transmission or reception of a communication signal to or from an external device, the pattern antenna comprising:

a first, inverted-F-shaped antenna pattern formed on a first surface of the circuit board, having one end serving as a feeding portion and another end left as an open end, having a bent portion formed between the feeding portion and the open end, with a portion of the first antenna pattern between the feeding portion and the bent portion serving as a feeding conductor pattern, and having a grounding conductor pattern formed so as to extend from a point between the feeding portion and the open end, wherein at least one of the feeding conductor pattern and the grounding conductor pattern is formed so as to have a trapezoid shape; and a second, inverted-L-shaped antenna pattern formed on a second surface of the circuit board, having one end serving as a grounding portion and another end left as an open end, and having a bent portion formed between the grounding portion and the open end, with a portion of the second antenna pattern between the grounding portion and the bent portion serving as a grounding conductor pattern, wherein the grounding conductor pattern is formed so as to have a trapezoid shape.

34. A wireless communication device comprising a pattern antenna that permits at least either transmission or reception of a communication signal to or from an external device, the pattern antenna comprising:

a first, inverted-L-shaped antenna pattern formed on a first surface of the circuit board, having one end serving as a feeding portion and another end left as an open end, and having a bent portion formed between the feeding portion and the open end, with a portion of the first antenna pattern between the feeding portion and the bent portion serving as a feeding conductor pattern, wherein the feeding conductor pattern is formed so as to have a trapezoid shape; and a second, inverted-L-shaped antenna pattern formed on a second surface of the circuit board, having one end serving as a grounding portion and another end left as an open end, and having a bent portion formed between the grounding portion and the open end, with a portion of the second antenna pattern between the grounding portion and the bent portion serving as a grounding conductor pattern, wherein the grounding conductor pattern is formed so as to have a trapezoid shape.

35. A wireless communication device comprising a pattern antenna that permits at least either transmission or reception of a communication signal to or from an external device, the pattern antenna comprising:

a plurality of first, inverted-F-shaped antenna patterns each formed on a surface of a layer or at an interface between layers constituting the multilayer circuit board, having one end serving as a feeding portion and another end left as an open end, having a bent portion formed between the feeding portion and the open end, with a portion of the first antenna pattern between the feeding portion and the bent portion serving as a feeding conductor pattern, and having a grounding conductor pattern formed so as to extend from a point between the feeding portion and the open end, wherein at least one of the feeding conductor pattern and the grounding conductor pattern is formed so as to have a trapezoid shape; and a plurality of second, inverted-L-shaped antenna patterns each formed on a surface of a layer or at an interface between layers constituting the multilayer circuit board, having one end serving as a grounding portion and another end left as an open end, and having a bent portion formed between the grounding portion and the open end, with a portion of the second antenna pattern between the grounding portion and the bent portion serving as a grounding conductor pattern, wherein the grounding conductor pattern is formed so as to have a trapezoid shape.

36. A wireless communication device comprising a pattern antenna that permits at least either transmission or reception of a communication signal to or from an external device, the pattern antenna comprising:

a plurality of first, inverted-L-shaped antenna patterns each formed on a surface of a layer or at an interface between layers constituting the multilayer circuit board, having one end serving as a feeding portion and another end left as an open end, and having a bent portion formed between the feeding portion and the open end, with a portion of the first antenna pattern between the feeding portion and the bent portion serving as a feeding conductor pattern, wherein the feeding conductor pattern is formed so as to have a trapezoid shape; and a plurality of second, inverted-L-shaped antenna patterns each formed on a surface of a layer or at an interface between layers constituting the multilayer circuit board, having one end serving as a grounding portion and another end left as an open end, and having a bent portion formed between the grounding portion and the open end, with a portion of the second antenna pattern between the grounding portion and the bent portion serving as a grounding conductor pattern, wherein the grounding conductor pattern is formed so as to have a trapezoid shape.

* * * * *